US010149364B2

(12) United States Patent
Dupras et al.

(10) Patent No.: US 10,149,364 B2
(45) Date of Patent: Dec. 4, 2018

(54) SYSTEM AND METHOD FOR GENERATING LIGHT REPRESENTATIVE OF A TARGET NATURAL LIGHT

(71) Applicant: SOLLUM TECHNOLOGIES INC., Montreal (CA)

(72) Inventors: Gabriel Dupras, Trois-Rivieres (CA); Francois Roy-Moisan, Trois-Rivieres (CA)

(73) Assignee: SOLLUM TECHNOLOGIES INC., Montreal, Quebec (CA)

( * ) Notice: Subject to any disclaimer, the term of this patent is extended or adjusted under 35 U.S.C. 154(b) by 0 days.

(21) Appl. No.: 15/546,783

(22) PCT Filed: Jan. 29, 2016

(86) PCT No.: PCT/CA2016/050076
§ 371 (c)(1),
(2) Date: Jul. 27, 2017

(87) PCT Pub. No.: WO2016/119063
PCT Pub. Date: Aug. 4, 2016

(65) Prior Publication Data

US 2018/0014375 A1 Jan. 11, 2018

Related U.S. Application Data

(60) Provisional application No. 62/109,101, filed on Jan. 29, 2015.

(51) Int. Cl.
*H05B 33/08* (2006.01)
*F21K 9/62* (2016.01)
*F21Y 115/10* (2016.01)

(52) U.S. Cl.
CPC ..... *H05B 33/0857* (2013.01); *F21K 9/62* (2016.08); *H05B 33/086* (2013.01); *F21Y 2115/10* (2016.08)

(58) Field of Classification Search
CPC ..... H05B 37/02; H05B 37/0245; H05B 37/0272; H05B 33/086; H05B 37/029;
(Continued)

(56) References Cited

U.S. PATENT DOCUMENTS 6,340,868 B1 1/2002 Lys et al.
7,067,992 B2 * 6/2006 Leong ..... F21K 9/00 315/291

(Continued)

FOREIGN PATENT DOCUMENTS

CA 2732086 1/2010

*Primary Examiner* — Haissa Philogene
(74) *Attorney, Agent, or Firm* — Thomas | Horstemeyer, LLP

(57) ABSTRACT

A lighting system and method for generating an output light beam representative of a target natural light are provided. The lighting system includes a plurality of solid-state light emitters each emitting a light sub-beam having an individual spectrum. The individual spectra of the solid-state light emitters collectively cover a visible portion of the natural light spectral profile and exclude infrared and ultraviolet components. The lighting system further includes a combining assembly combining the light sub-beams into the output light beam. A control module controls an intensity of the light sub-beam from each of the solid-state light emitters such that the resulting combined spectral profile of the output light beam is representative of a natural light spectral profile of the target natural light over its visible portion.

23 Claims, 9 Drawing Sheets

(58) Field of Classification Search
CPC ..... F21K 9/17; F21K 9/175; F21Y 2101/02; F21Y 2103/003; F21Y 2103/10; F21Y 2115/10
See application file for complete search history.

(56) References Cited

U.S. PATENT DOCUMENTS

| | | | | |
|---|---|---|---|---|
| 8,592,748 | B2 | 11/2013 | Gall et al. | |
| 9,066,404 | B2 * | 6/2015 | Paolini | G06Q 30/0641 |
| 9,169,977 | B2 * | 10/2015 | Medendorp, Jr. | F21K 9/17 |
| 9,235,039 | B2 * | 1/2016 | Lee | G02B 21/06 |
| 9,801,261 | B2 * | 10/2017 | Lurie | H05B 37/0245 |

* cited by examiner

SYSTEM AND METHOD FOR GENERATING LIGHT REPRESENTATIVE OF A TARGET NATURAL LIGHT

CROSS-REFERENCE TO RELATED APPLICATIONS

This application is the 35 U.S.C. § 371 national stage application of PCT Application No. PCT/CA2016/050076, filed Jan. 29, 2016, where the PCT claims the benefit of U.S. Provisional Application Ser. No. 62/109,101 filed on Jan. 29, 2015, both of which are herein incorporated by reference in their entireties.

TECHNICAL FIELD

The technical field generally relates to light sources and more particularly concerns a system and a method for generating an output light beam which has a spectral profile representative of a target natural light over the visible spectrum, which excluding undesirable wavelengths such as infrared and ultraviolet components.

BACKGROUND

Lamp units developed to illuminate a space, surface or an object use different materials, designs and are applicable for multiple lighting purposes. The majority of such lamp units are now generally known to employ Light Emitting Diode ("LED") technology as a replacement for conventional incandescent and/or fluorescent lighting to provide a lighting source that generates white light having a relatively high Colour Rendering Index ("CRI"), so that spaces, surfaces, and objects illuminated by the lighting appear as if illuminated by natural sunlight. The ability of a light source to render the color of an object is measured using the CRI which provides a measure of how a light source makes the color of an object appear to the human eye and how well subtle variations in color shade are revealed. In applications where accurate color rendition is required, such as for example retail lighting, museum lighting and lighting of artwork, a high CRI typically of at least 80 is highly desirable.

Lighting technologies that are currently available on the market (e.g. halogen or fluorescent) have unstable spectral outputs which shift over their lifetimes due to high operating temperatures tending to degenerate the chemicals employed to emit light, thus reducing the CRI for these light sources. As a consequence, white LEDs are increasingly being used to replace conventional fluorescent, compact fluorescent and incandescent light sources due to their long operating life expectancy and high luminous efficacy. However, one of the drawbacks associated with white LEDs is related to their spectrum output which have undesirable light wavelengths such as the ultraviolet ("UV") and Infrared ("IR") wavelengths. The use of filters to eliminate these undesirable UV and IR wavelengths allow the visible light to pass while decreasing the intensity of the unwanted wavelengths. However, employing filters also significantly decreases the intensity of the visible light and still UV and IR wavelengths may not be fully attenuated.

Yet another drawback of white LEDs relates to spikes in the light spectrum caused by white LEDs which reduces the CRI quality. For example, U.S. Pat. No. 8,592,748 B2, issued to Gall et al., entitled "Method and arrangement for simulation of high-quality daylight spectra," discloses a method and a multispectral color coordination system that simulates high-quality daylight spectra using LEDs disposed in groups with each group emitting light at different wavelengths within the daylight spectrum. The wavelength of the light emitted by the white LED creates a spike in the spectral power distribution curve which contains a large portion of yellow-green to yellow light in a spectral range of 555 to 590 nm not representative of natural lighting.

While Red-Blue-Green ("RGB") coloured LED combinations may be employed to produce white light without employing white LEDs, such a combination of LEDs however do not provide a uniform spectral progression between the wavelengths ranging between from 380 nm to 780 nm to properly simulate natural light. Since colored light emitting diodes produce light only at specific wavelengths with the spectral power distributions of the component LEDs being relatively narrow, perceivable color shift occurs.

Therefore, what is needed is a system and method for creating natural day-light spectra with High-CRI or High-Color Quality Scale ("CQS") without the use of white LEDs and without undesirable UV and IR wavelengths.

SUMMARY

In accordance with one aspect, there is provided a lighting system for generating an output light beam representative of a target natural light having a natural light spectral profile. The lighting system includes:

- a plurality of solid-state light emitters each emitting a light sub-beam having an individual spectrum, the individual spectra of the solid-state light emitters collectively covering a visible portion of the natural light spectral profile and excluding infrared and ultraviolet components;
- a combining assembly combining the light sub-beams from said solid-state light emitters into the output light beam such that said output light beam has a combined spectral profile defined by a combination of the individual spectra of the plurality of solid-state emitters; and
- a control module configured for controlling an intensity of the light sub-beam from each of the solid-state light emitters such that the combined spectral profile of the output light beam is representative of the natural light spectral profile of the target natural light over said visible portion.

The solid-state emitters may be Light Emitting Diodes.

In some embodiments the control module includes a controller configured to control driving parameters of the solid-state emitters, and may further include a memory in communication with the controller and storing the driving parameters.

The control module may include a plurality of emitter drivers, each emitter driver being associated with a corresponding one of the solid-state light emitters.

In some implementations the control module controls the solid-state emitters according to a Pulse Width modulation scheme.

The combining assembly may include a support structure on which the solid-state light emitters are mounted. The light emitters are preferably positioned on the support structure such that the sub-beams project towards a diffusing plane. The combining assembly preferably further includes a diffuser extending along the diffusing plane, the diffuser blending the sub-beams into said output beam.

The plurality of solid-state light emitters may consist of between 10 and 20 of said light emitters. The plurality of solid-state light emitters may consist of colored light emitters only, or may include a plurality of colored light emitters and at least one white light emitter.

The combined spectral profile for example spans a wavelength range extending between about 350 and 750 nm, or a wavelength range extending between about 400 and 700 nm.

The control module may be configured to control the intensity of the light sub-beams according to a plurality of sets of relative intensity values each providing a combined spectral profile representative of a different natural light.

In accordance with one aspect, there is also provided a method for generating an output light beam representative of a target natural light having a natural light spectral profile, the method comprising:

(a) providing a plurality of solid-state light emitters each emitting a light sub-beam having an individual spectrum, the individual spectra of the solid-state light emitters collectively covering a visible portion of the natural light spectral profile and excluding infrared and ultraviolet components;

(b) combining the light sub-beams from said solid-state light emitters into the output light beam such that said output light beam has a combined spectral profile defined by a combination of the individual spectra of the plurality of solid-state emitters; and (c) controlling an intensity of the light sub-beam from each of the solid-state light emitters such that the combined spectral profile of the output light beam is representative of the natural light spectral profile over said visible portion.

In some implementations the controlling of the solid-state emitters may be performed according to a Pulse Width modulation scheme.

The combining of the light sub-beams may include:

projecting the light sub-beams towards a diffusing plane; and blending the sub-beams into said output beam using a diffuser extending along the diffusing plane.

The plurality of solid-state light emitters consists of between 10 and 20 of said light emitters. The plurality of solid-state light emitters may consist of colored light emitters only, or may include a plurality of colored light emitters and at least one white light emitter.

The combined spectral profiles may for example span a wavelength range extending between about 350 and 750 nm, or a wavelength range extending between about 400 and 700 nm.

In some implementations of the method the intensity of the light sub-beams is controlled according to a plurality of sets of relative intensity values each providing a combined spectral profile representative of a different natural light.

In accordance with some implementations, there is provided a lighting system for generating a target natural light comprising a plurality of solid-state light emitters each controllable to emit light having an individual spectrum. A combination of the individual spectra of the plurality of solid-state light emitters defines a spectral distribution representative of the target natural light and spans a spectral range excluding infrared and ultraviolet components. The system also includes a controller for individually controlling an intensity of the light emitted by each of the solid-state light emitters such that the combination of the individual spectra of the plurality of solid-state light emitters has the spectral distribution representative of the target natural light.

In some variants, the lighting system excludes a filter for blocking the infrared and ultraviolet components.

The spectral distribution representative of the target natural light may include wavelengths within a spectral range ranging from about 400 nm to about 700 nm.

The target natural light may match the D65 daylight spectral distribution standard.

The lighting system may include or exclude a white solid-state light emitter.

The lighting system as above may for example be used for the illumination of artwork or for the illumination of one or more plants.

In some embodiments, the lighting system can further include a plurality of drivers connected to the solid-state light emitters for generating a plurality of PWM signals with adjustable duty cycles and frequencies for driving the solid-state light emitters, wherein the intensity of the light emitted by each of the solid-state light emitters is proportional to the PWM signal.

In accordance with some implementations there may be provided a method of generating a target natural light comprising the steps of:

providing a plurality of solid-state light emitters each independently controllable to emit light having an individual spectrum spanning a spectral range excluding infrared and ultraviolet components;

individually controlling an intensity of the light emitted by each of the solid-state light emitters such that a combination of the individual spectra of the plurality of solid-state light emitters has the spectral distribution representative of the target natural light; and combining the individual spectra of the plurality of solid-state light emitters.

In some variants the step of individually controlling an intensity of the light emitted by each of the solid-state light emitters may include varying the intensity over time to generate a time varying spectral distribution representative of the target natural light matching seasonal natural light cycle.

The step of varying the intensity over time may be varied at a rate greater than the seasonal natural light cycle.

The step of varying the intensity over time may be varied to match a portion of the seasonal natural light cycle.

The step of supplying the solid-state light emitters with PWM signals may include adjustable duty cycles and frequencies, wherein the intensity of the light emitted by each of the solid-state light emitters is proportional to the PWM signal.

Other features and advantages of the invention will be better understood upon a reading of embodiments thereof with reference to the appended drawings.

DETAILED DESCRIPTION

Figure 1:
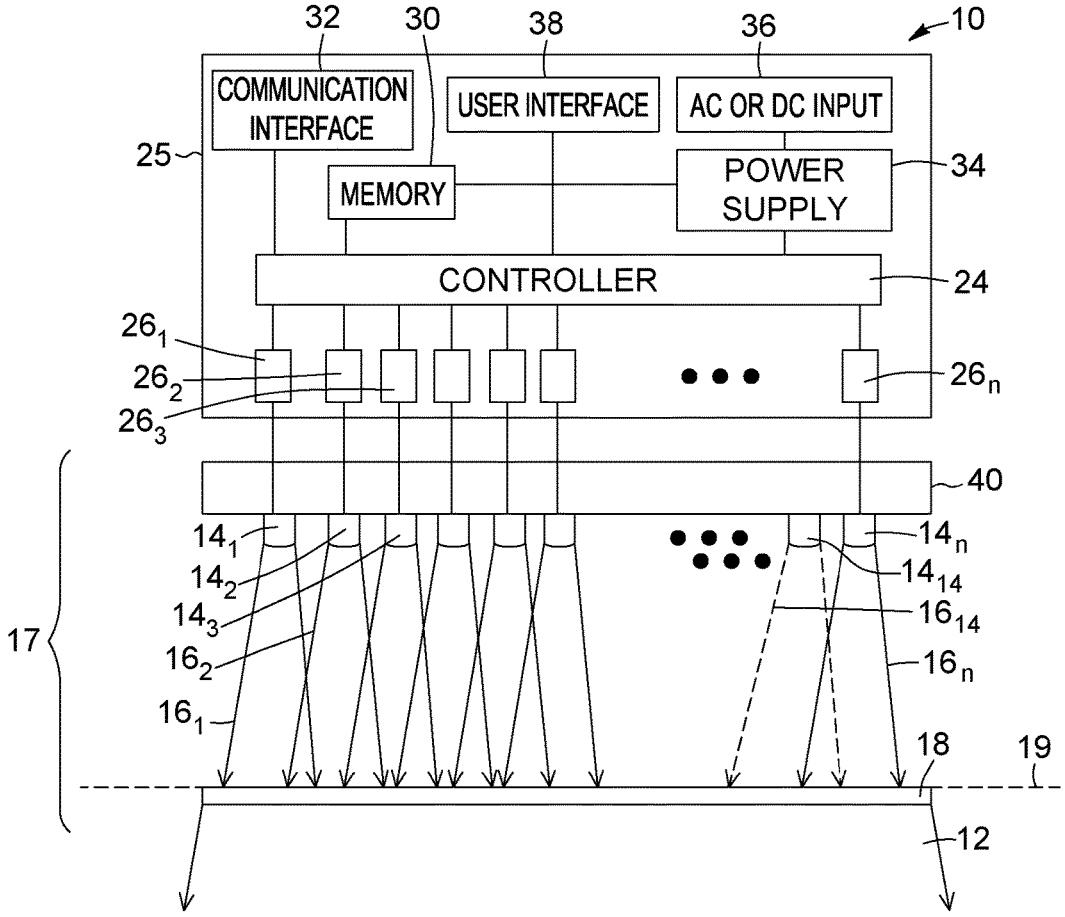
FIG. 1 is schematized representation of a lighting system according to an embodiment.

In accordance with one aspect, the present description relates to a lighting system for generating an output light beam representative of a target natural light.

The expression "natural light" is understood in the art to refer to light which has similar spectral characteristics as light of the sun reaching the earth. Such light has a natural spectral profile, defined as the variation in light intensity as a function of wavelength. As known to those skilled in the art, the spectral profile of light from the sun can vary depending of several factors such as the time of the day, the period of the year or the geographic location.

Several standards are known in the art to provide a spectral reference for natural light. For example, the Commission Internationale de L'Eclairage (hereinafter "CIE") has established the "D" series of well-defined daylight illuminant standards representing natural light under different conditions. One well known standard is the CIE illuminant D65, which represents a midday sun in Northern/Western Europe. Other examples of CIE illuminant standards for daylight include the D50, D55 and D75 illuminant standards.

Light from the sun includes wavelengths covering a broad spectral range from ultraviolet to infrared light. Accordingly, illuminant standards also extend over the same range. For example, the D65 illuminant standard extends from 300 nm to 830 nm.

For some applications, it may be advantageous to provide illumination which is as close as possible to sun light in the visible portion of the spectrum, so that the illumination provided is aesthetically reminiscent of being outdoors, while excluding wavelengths in the ultraviolet and infrared range which may be undesirable. The output light beam representative of a target natural light generated by lighting systems according to various embodiments of the invention may therefore span a spectral range excluding infrared and ultraviolet components, i.e. limited to visible light. For example, light in the ultraviolet (UV) or infrared (IR) range can be damageable to artworks or other objects which can suffer degradation from exposure to such light. Lighting systems according to embodiments can thus be useful in the context of show rooms, exhibition halls and rooms, jewelry displays, clothing retailers, photo centers, photographic lighting, cinema and movie lighting, medical, dentistry, medical operating rooms, and other applications where natural lighting is required. Alternatively, the lighting system is applicable where it is desirable that natural lighting excludes UV and IR wavelengths which may be damaging to the surface or object being illuminated, for example plants in agriculture and farming applications, as well as other industries requiring day-light spectra.

It will be readily understood by one skilled in the art that the limits between the visible range and the ultraviolet and infrared ranges can vary according to the definitions considered. For example, several references in the field define the visible spectral range as extending between wavelengths of 400 nm and 720 nm, with the ultraviolet range extending between 10 nm and 400 nm and the infrared range between 720 nm and 1 mm. This convention is however given by way of example only and different wavelength ranges could be considered as target natural light in different circumstances (for example defining visible light within a spectral range between wavelengths of 380 nm and 700 nm).

Referring to FIG. 1, there is schematically illustrated a lighting system 10 according to one embodiment.

The lighting system 10 includes a plurality of solid-state light emitters 14, which are designed to each emit a light sub-beam 16 having an individual spectrum.

The expression "solid-state light emitter" is herein understood to refer to any solid state light emitting device and may include a Light Emitting Diode (LED), an organic light emitting diode, and/or other semiconductor light emitting device or lamp that generates light through the recombination of electronic carriers, i.e. electrons and holes, in a light emitting layer or region which may include silicon, silicon carbide, gallium nitride and/or other semiconductor materials which may or may not include a substrate such as a sapphire, silicon, silicon carbide and/or other microelectronic substrates.

The individual spectra of the solid-state light emitters 14 collectively cover a visible portion of the natural light spectral profile, while excluding infrared and ultraviolet components. Each solid-state light emitter 14 may therefore emit coloured light including, blue, cyan, and/or green as well as red and/or amber etc. Of note, while in some implementations each solid-state light emitter 14 emits coloured light, one or more solid-state light emitters emitting white light may also be included.

In some implementations, the individual spectrum of each solid state emitters 14 may be selected with a center wavelength and spectral range such that it partially overlaps, and preferably overlaps at least at Full Width at Half Maximum (FWHM) or higher, with a spectrally adjacent individual spectrum. The expression "FWHM" is understood in the art to mean the extent of a function, given by the difference between the two extreme values of the independent variable at which the dependent variable is equal to half of its maximum value. In one example, the above condition may be achieved with solid state light emitters 14 illustratively selected having at most a 15 nm of difference from the centered wavelength of each other, with an average FWHM of about 30 nm. If solid state light emitters 14 with a wider spectrum are selected, such a difference between the centered wavelengths could be larger.

In one embodiment, fifteen solid-state light emitters $\mathbf{14}_1$, $\mathbf{14}_2, \ldots, \mathbf{14}_{15}$ are included in the lighting system 10. In such a variant, the individual spectra of the solid-state light emitters may for example have centered wavelengths within the range as described below:

| | Min WL | Max WL |
|---|---|---|
| 1 | 405 | 420 |
| 2 | 420 | 440 |
| 3 | 440 | 460 |
| 4 | 460 | 480 |
| 5 | 480 | 500 |
| 6 | 500 | 520 |
| 7 | 520 | 540 |
| 8 | 540 | 560 |
| 9 | 560 | 580 |
| 10 | 580 | 600 |
| 11 | 600 | 620 |
| 12 | 620 | 640 |
| 13 | 640 | 660 |
| 14 | 660 | 680 |
| 15 | 680 | 700 |

Figure 2:
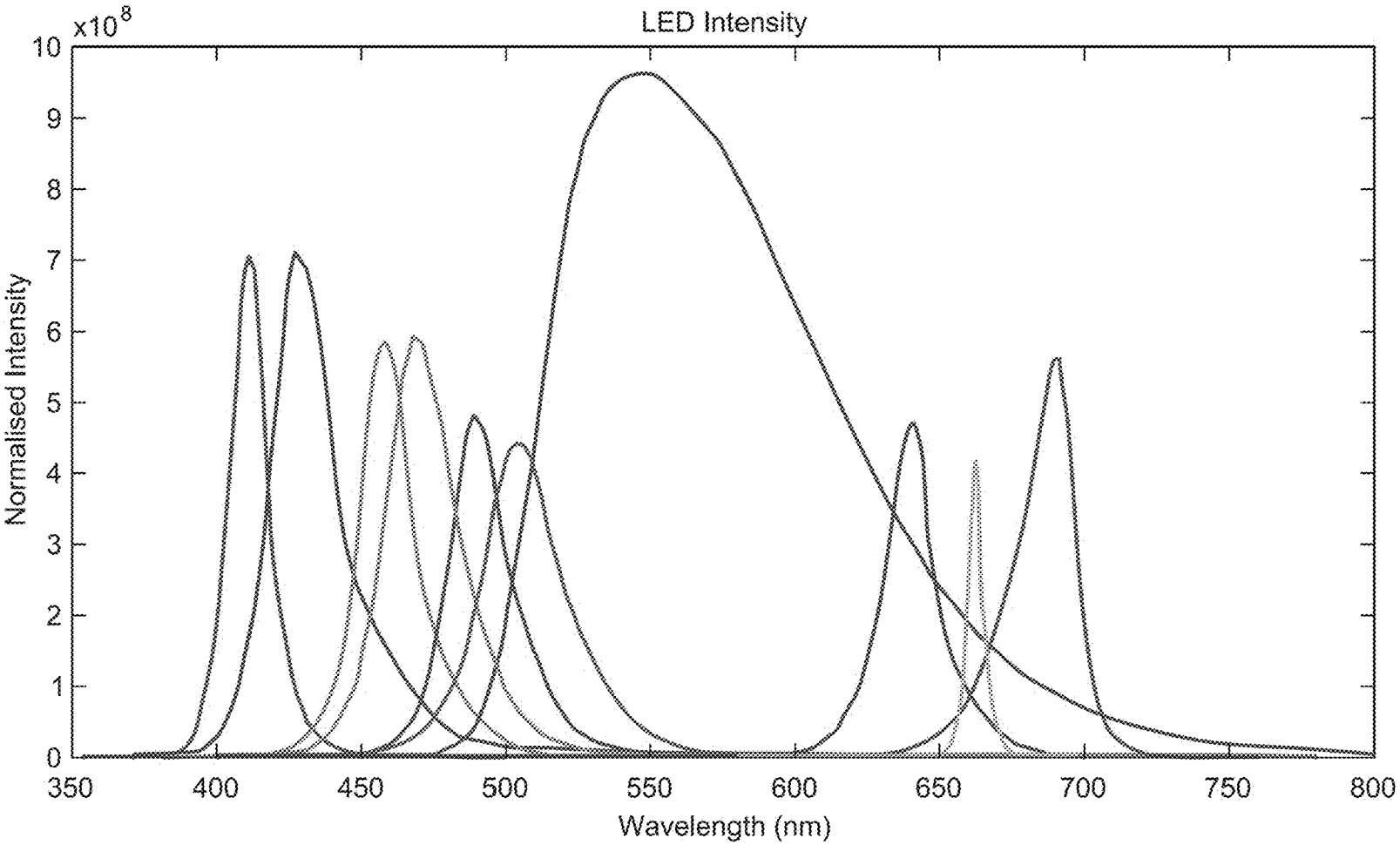
FIG. 2 is a graph showing the individual spectra of light sub-beams produced by light emitters of a lighting system according to one embodiment, without any white emitter.

Referring to FIG. 2, the individual spectra $\mathbf{20}_i$ of light sub-beams provided by a plurality of solid-state light emitters according to one embodiment is shown. In the illustrated variant ten light sub-beam each having a distinct color are shown, and no white light emitter is included. As can be seen, the different light emitter have partially overlapping spectra, such that the addition of all of these spectra covers the entire visible range, while excluding infrared and ultraviolet wavelengths. It will be readily understood that the term "excluding" in this context is not meant to refer to a mathematical value of zero light intensity within the UV and IR range, but that any light components within these ranges are weak enough to be negligible with respect to the portion of the light in the visible range, and/or that UV and IR components are too small to impart significant damages to objects being lighted in the target application of the lighting system.

As illustrated in FIG. 1 and FIG. 2, fourteen solid-state light emitters 14 have been provided as part of the lighting system 10, but more or less solid-state light emitters $\mathbf{14}_n$ for generating an equivalent number of individual spectra $\mathbf{20}_n$ may be provided depending on the design and illumination requirements of the lighting system 10. Each solid-state light emitter 14 may emit the light sub-beam 16 having an individual spectrum $\mathbf{20}_1$ to $\mathbf{20}_{14}$ of the respective solid-state light emitters $\mathbf{14}_1$ to $\mathbf{14}_{14}$ that when combined illustratively span a wavelength spectrum ranging between 360 nanometers (nm) to 750 nm.

Referring back to FIG. 1, the lighting system further includes a combining assembly 17 combining the light sub-beams $\mathbf{16}_i$ from the solid-state light emitters $\mathbf{14}_i$ into the output light beam 12. The combining assembly 17 is configured such that the resulting output light beam 12 has a combined spectral profile defined by a combination of the individual spectra of the plurality of solid-state emitters $\mathbf{14}_i$. The combining assembly may include any one or combination of mechanical component and/or optical components cooperating to appropriately mix the light sub-beams $\mathbf{16}_i$ together. In one implementation, such as illustrated in FIG. 1, the combining assembly 17 may include a support structure 40 on which the solid-state light emitters $\mathbf{14}_i$ are mounted, and preferably positioned such that the sub-beams $\mathbf{16}_i$ project towards a diffusing plane 19. The combining assembly 17 further includes a diffuser 18 extending along the diffusing plane 19. As one skilled in the art will readily understand, the diffuser 18 may be embodied by any optical component or combination of components blending light of the sub-beams 16*i* into the output beam 12. The diffuser may for example be embodied by sandblasted glass or plastic or other types of light mixing optics. The diffuser may be oriented or directed to illuminate an object or surface with the output beam 12.

In some variants, for example if the object or surface to be illuminated is sufficiently distanced from the lighting system 10, the combining assembly may omit components to blend the light from the individual solid-state 14 together and simply direct the light sub-beams 16 a same optical path. In one example the light emitted by each solid-state light emitter may be directed by angled reflectors (not shown). Also, while the lighting system 10 described herein eliminates the necessity of employing filters to limit the light passband to remove IR and UV components, filters or coatings (not shown) on the solid-state light emitters 14 or the diffuser or mixing optics 18 may be provided for such a purpose, or for creating different spectra of light.

Still referring to FIG. 1, the lighting system 10 further includes a control module 25 configured for controlling an intensity of the light sub-beam $\mathbf{16}_i$ from each of the solid-state light emitters $\mathbf{14}_i$ such that the combined spectral profile of the output light beam 12 is representative of the natural light spectral profile of the target natural light over the visible portion.

The control module 25 may be embodied by any one or combination of devices, hardware, software, circuits, processors, and other components adapted to carry out the control of the individual intensities of the solid-state light emitters $\mathbf{14}_i$. In the illustrated implementation the control module first includes a controller 24. The controller 24 may be illustratively a processor, or micro-controller, for example an ATmega328, Intel 8051, PIC, a Texas Instruments MSP430, or an ARM processor. The controller 24 is preferably configured to control driving parameters of the solid-state emitters 14. The control module 25 may for example include a plurality of emitter drivers $\mathbf{26}_i$ receiving the driving parameters as signals from the controller 24. Each emitter driver $\mathbf{26}_i$ is associated with a corresponding one of the solid-state light emitters $\mathbf{14}_i$ and supplies a current to cause the corresponding solid-state light emitter 14 to generate or output the light sub-beam 16.

For example, each of the solid-state light emitters $\mathbf{14}_1$ to $\mathbf{14}_{14}$ are individually driven by respective drivers $\mathbf{26}_1$ to $\mathbf{26}_{14}$ which may be scaled to an $n^{th}$ number of drivers $\mathbf{26}_n$ for an $n^{th}$ number of solid-state light emitters $\mathbf{14}_n$. As is generally known in the art, a solid-state light emitter 14 such as a LED generates or outputs light when a current is driven across a p-n junction in the semiconductor diode (not shown) of the LED. The intensity of the light generated by the LED is thus correlated to the amount of current driven through the diode. In one variant, the control module controls the solid-state emitters according to a Pulse Width Modulation (PWM) scheme, a known method for controlling the current driven through a LED to achieve desired intensity and/or color mixing. A PWM scheme alternately pulses the LED to a full current "ON" state followed by a zero current "OFF" state. Depending on the command that is given, by controlling the variation of the duty cycle (0-100%), the average luminous power emitted by the LED proportionally increases or decreases. The intensity and the temperature of LED may thus be controlled by the PWM signals issued to the plurality of emitter drivers 26 by the controller 24. The intensities of the individual spectrum $\mathbf{20}_1$ to $\mathbf{20}_{14}$ of the light sub-beams 16 emitted by each solid-state light emitter 14, or LEDS in the context of the present example, may be dependent on different working temperatures and different PWM values. Moreover, the controller 24 may be illustratively configured to control the current driven through the solid-state light emitters 14 using one or more control schemes. For example, to maintain the total lumen output of the lighting system during a dimming function of the lighting system 10, the controller 24 may regulate the electric current to the solid-state light emitters 14 using built-in mathematical equations and solid-state light emitter parameter database (not shown) containing information such as LED efficacy, intensity-temperature relations, color shift-temperature relations, the eight CCT quadrangles, etc. to individually and proportionally control the intensities of the solid-state light emitters 14.

Still referring to FIG. 1, in operation of the lighting system 10, signals are sent to the emitter drivers 26 from the controller 24. Each emitter driver 26 then sends its own PWM current pulse to its associated solid-state light emitters 14. The luminous intensity of the resultant output light sub-beams 16 may be individually adjusted by independently applying particular drive currents to the respective solid-state light emitters according to the control signals from the controller 24. Thus, the intensity of each solid-state light emitter 14 may be adjusted to power the solid-state light emitters 14 high or low for generating the output light beam 12. The controller 24 is able to individually control the plurality of driving signals from each emitter driver 26 to a respective solid-state light emitter 14 so that the resulting combined spectral profile of the output light beam is representative of the natural light spectral profile of the target natural light over said visible portion. Additionally, since each spectrum 20 can be more accurately controlled by the controller 24, energy can be conserved. In accordance with one embodiment of the invention, the frequencies of the PWM signal may also be adjustable in the ranges between 100 Hz to 10 kHz for implementing lighting functions, such as dimming for example. A high PWM frequency may be utilized (e.g., between 150 Hz and 1 KHz) such that the on and off flickering of the solid-state light emitters 14 is generally not perceptible to the naked eye.

As mentioned above, the intensity of the light sub-beam $\mathbf{16}_i$ from each of the solid-state light emitters $\mathbf{14}_i$ is controlled by the control module 25 such that the combined spectral profile of the output light beam 12 is representative of the natural light spectral profile of the target natural light over the visible portion.

It will be readily understood that the natural light spectral profile of the target natural light may be determined or selected in a variety of manners depending on the intended use of the lighting system. In some embodiments, the natural light spectral profile may match a daylight spectral distribution standard such as the D65 standard from the CIE. Other standards of interest may include the D50, D55 and D75 standards as well as the A, B, C or D standards. It will be readily understood that these standards are meant to represent natural light in a particular location on Earth at a particular time of a particular day of the year. It is well known that the spectrum of natural light varies according to seasons, time of day and physical location. Accordingly, in alternative embodiments the natural light spectral profile of the target natural light may be selected according to any desired natural light output. This may for example be realized by acquiring the spectrum of outdoors ambient light at the location, time and season of interest and using the collected information as the target light.

The natural light spectral profile may be associated with a given color temperature (in Kelvin degrees), as known in the art. Wikipedia defines the color temperature of a light source is the temperature of an ideal black-body radiator that radiates light of comparable hue to that light source. Characterising light from the sun according to color temperature is often considered a valid approximation as the sun can be considered close to an ideal black-body radiator. The color temperature of the D65 standard is about 6500 K.

It some embodiments, the target natural light may be a nighttime light, for example representative of star light and/or light reflected off the moon.

Figure 3:
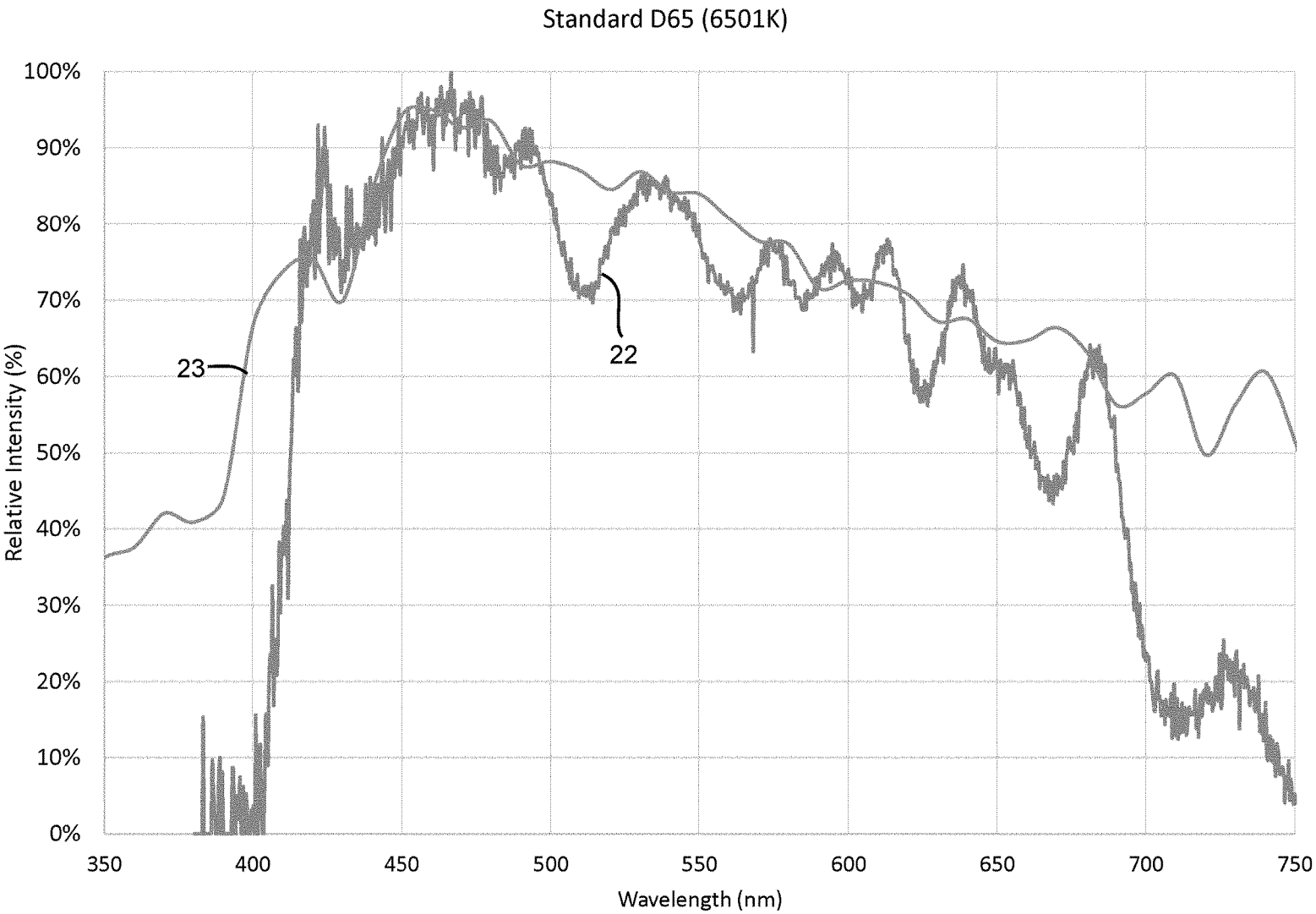
FIG. 3 is a graph comparing the combined spectral profile of the output beam according to one embodiment with the D65 standard.
Figure 4:
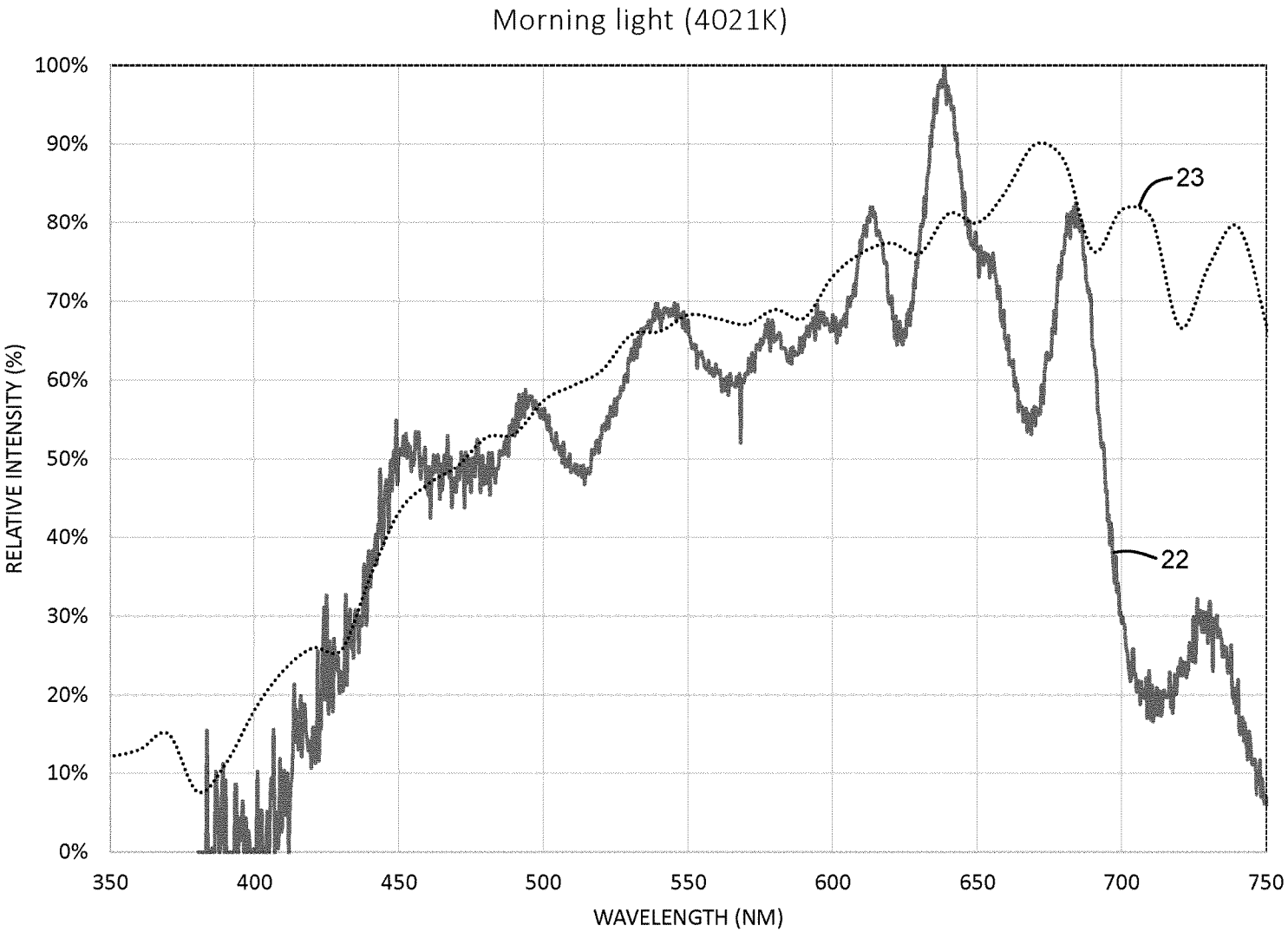
FIG. 4 is a graph comparing the combined spectral profile of the output beam according to one embodiment with an acquired spectral of natural light at a color temperature of 4021 K.
Figure 5:
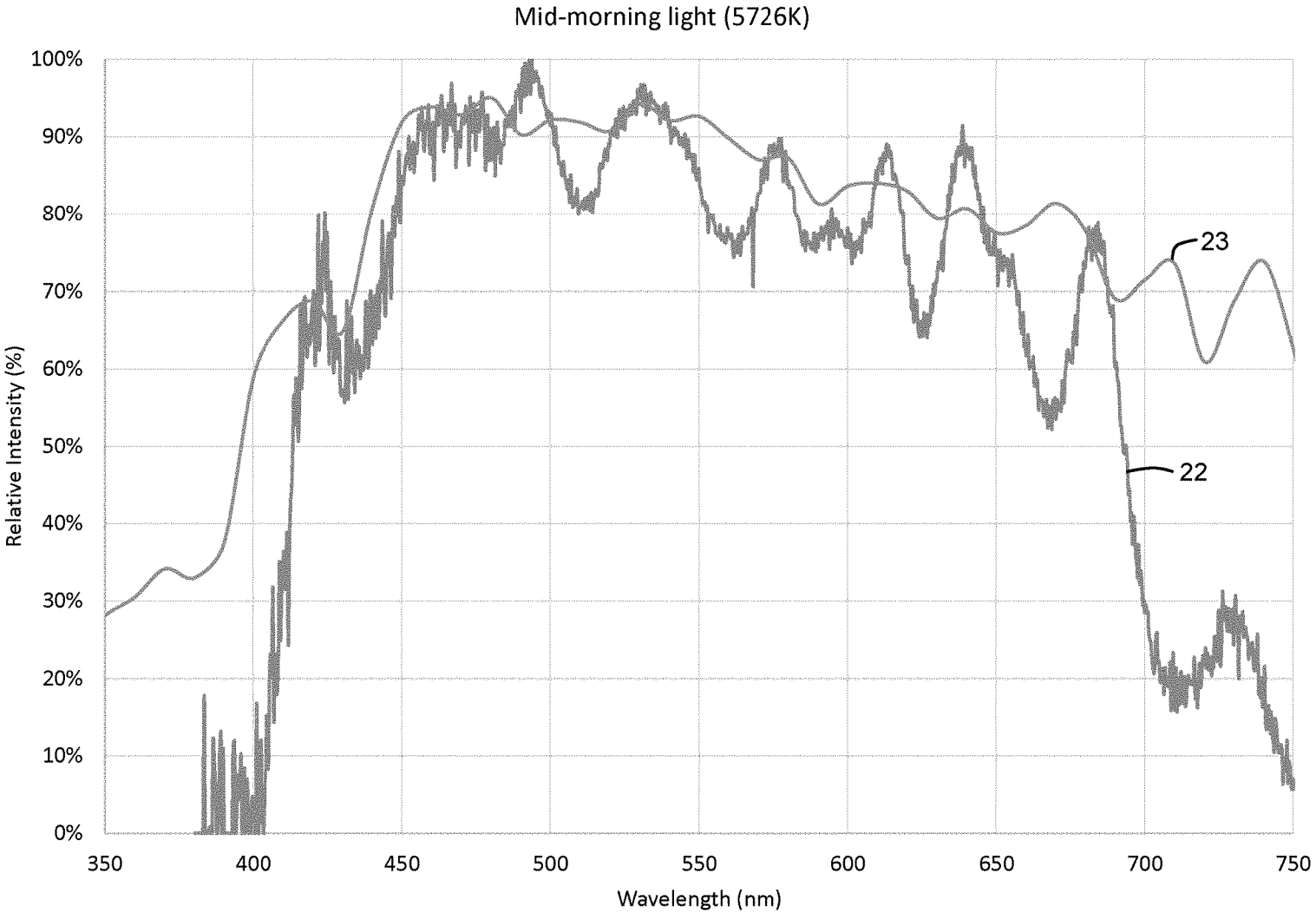
FIG. 5 is a graph comparing the combined spectral profile of the output beam according to one embodiment with an acquired spectral of natural light at a color temperature of 5726 K.
Figure 6:
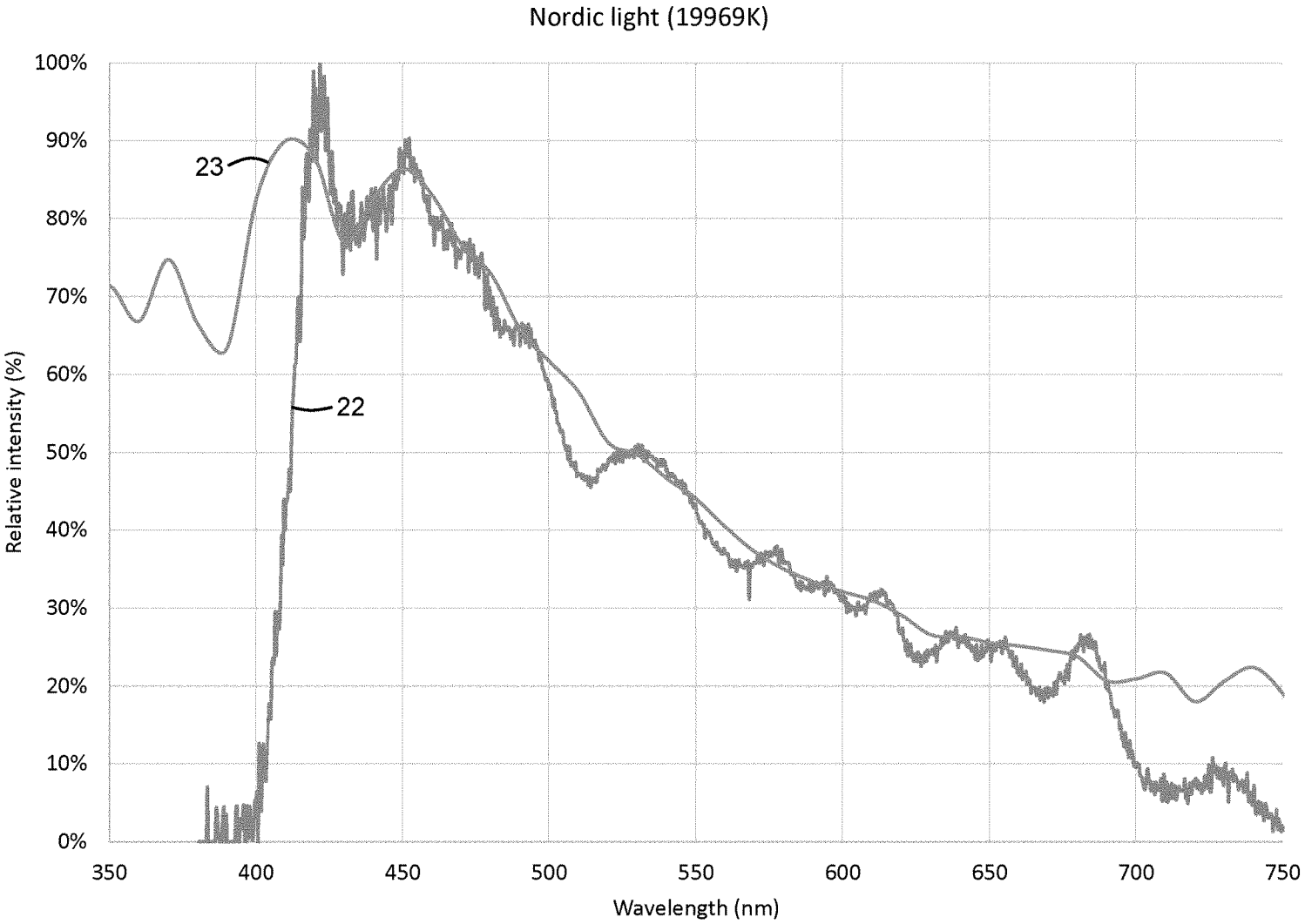
FIG. 6 is a graph comparing the combined spectral profile of the output beam according to one embodiment with an acquired spectral of natural light at a color temperature of 19969 K, representative of Nordic light.

Referring to FIG. 3, there is shown one example of an embodiment where the solid-state light emitters 14 may emit light sub-beams 16 having an intensity simulating the D65 standard, but limited in spectral range with combined spectral profile 22 having wavelengths ranging between 380 nm to 750 nm, and thus excluding Infrared (IR) and Ultraviolet (UV) wavelengths. The combine light spectral profile shown in this figure results from the combining of individual light sub-beams from 14 colored light emitters and 1 white light emitter.

As will be observed from the graph of FIG. 3 and other comparative spectra herein, the combined spectral profile 22 of the output light beam does not need to be an exact match to the natural light spectral profile of the target natural light over the visible portion in order to be considered "representative" of the same. In some embodiments, it may suffice that the general shape of the natural light spectral profile be reproduced in order for the eye to perceive the same "color" or "shade" of white. Eye perception can vary from one individual to the next. In some embodiments, the combined spectral profile of the output light beam may be considered representative of the natural light spectral profile of the target natural light if both spectral profiles match over the visible portion within a 5% error range.

Implementations of the lighting system 10 allow the shaping the combined spectral profile 22 according to the needs the designer and the desired application of a target natural light. For example, the lighting system 10 can be tuned such that the combined spectral profile 22 is compliant with museum lighting conservation standards, and that there are no deterioration agents, for example UV spectrum lower than 400 nm and IR spectrum higher than 750 nm and higher, which are generated by the lighting system 10. That is, the lighting system 10 is able to be tuned to generate natural daylight without the harmful UV and IR components. Alternatively, embodiments of the lighting system 10 can be used to simulate a representation of any standard that redefines the UV and IR wavelengths limits. For example, if the UV wavelengths are defined as being 420 nm and below and the IR wavelengths are defined as 700 nm and higher, according to such a standard, the lighting system 10 can generate a combined spectral profile 22 which excludes or includes such wavelengths by reducing the intensities of the solid-state light emitters $\mathbf{14}_1$ and $\mathbf{14}_{14}$ output light sub-beams 16 near such wavelengths can be reduced accordingly.

Still referring to FIG. 1, in one implementation the lighting system 10 able to efficiently and accurately recreate the natural light, such as daylight, which is defined by the CIE Standard Illuminant D65, as is generally known in the art, and which has been illustrated in FIG. 3. Since the intensities of the solid-state light emitter 14 are individually controllable, the combined spectral profile 22 obtained from a same set of light emitters can be tailored to match different target lights, for example the standards A, B, C and D. The relative intensity of different light sub-beams ca be modified and/or different wavelengths from 380 nm to 800 nm can be added and removed, for example by controlling the intensity of the solid-state light emitter 14 as described hereinabove to activate or deactivate a solid-state light emitter 14, to comply with any desired standard or for a specific need. The control offered by the lighting system 10 of some embodiments generates a resultant output light beam 12 with a completely tunable spectrum thereby providing a tunable CRI and tunable CQS. A resultant output light beam 12 may be tuned to have a homogeneous spectral progression.

Figure 7:
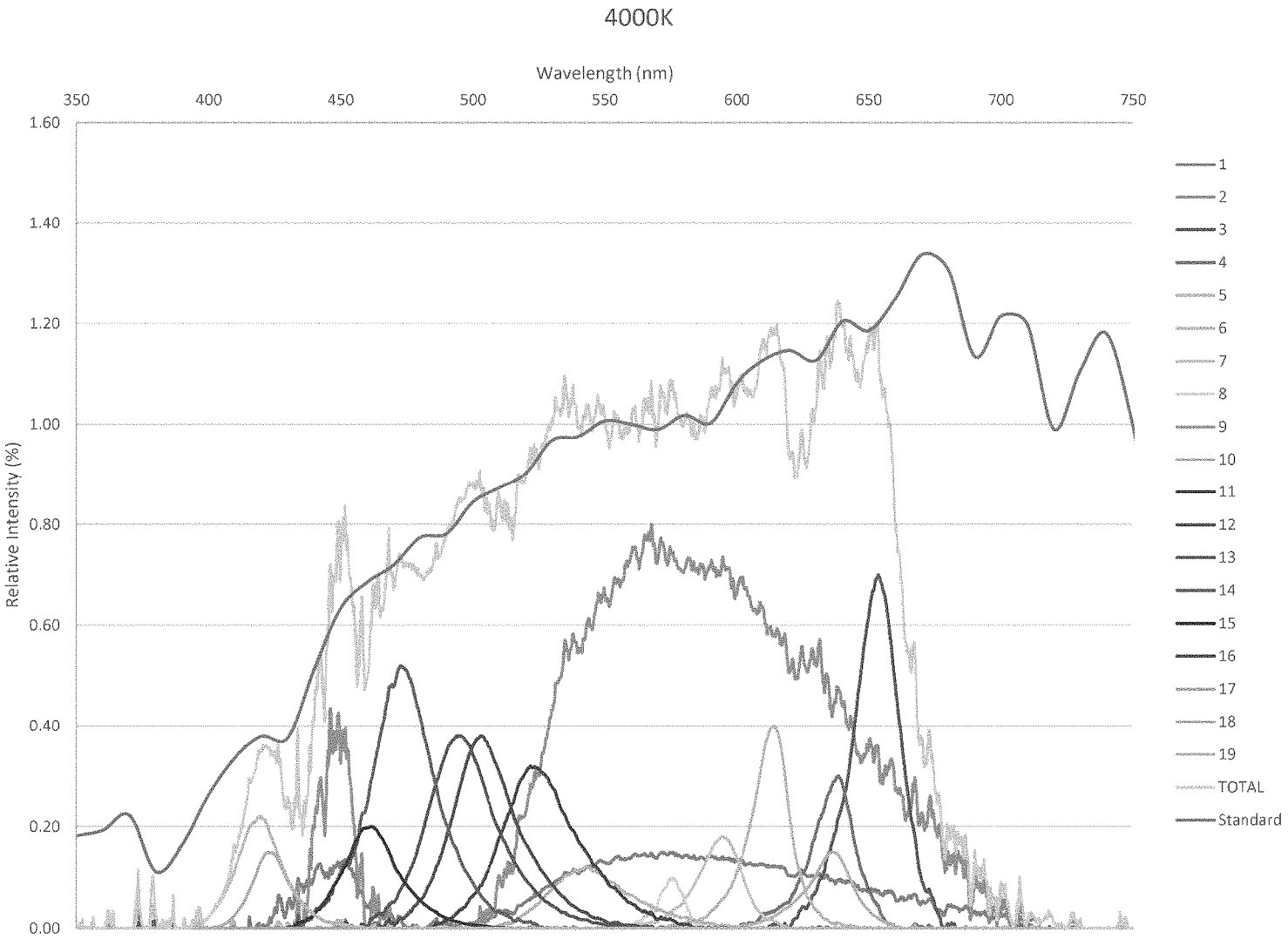
FIG. 7 is a graph showing the individual spectra of light sub-beams produced by a set of 18 colored light emitters and 1 white light emitter of a lighting system according to one embodiment, with relative intensities configured to provide natural light at a color temperature around 4000 K, as well as the combined spectral profile of the combination of the sub-beams compared with an acquired spectral of natural light at the same color temperature.
Figure 8:
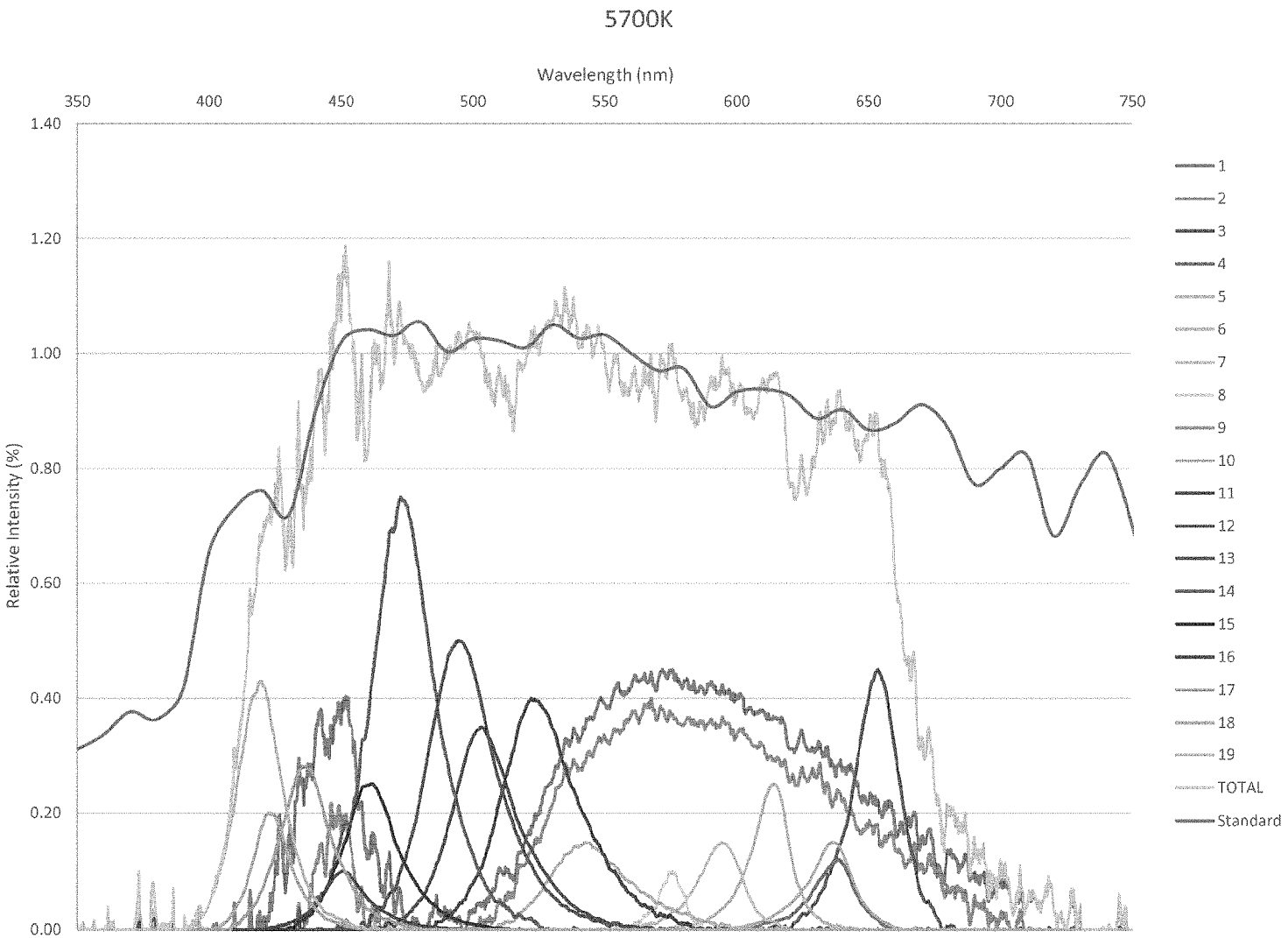
FIG. 8 is a graph showing the individual spectra of light sub-beams produced by a set of 18 colored light emitters and 1 white light emitter of a lighting system according to one embodiment, with relative intensities configured to provide natural light at a color temperature around 5700 K, as well as the combined spectral profile of the combination of the sub-beams compared with an acquired spectral of natural light at the same color temperature.
Figure 9:
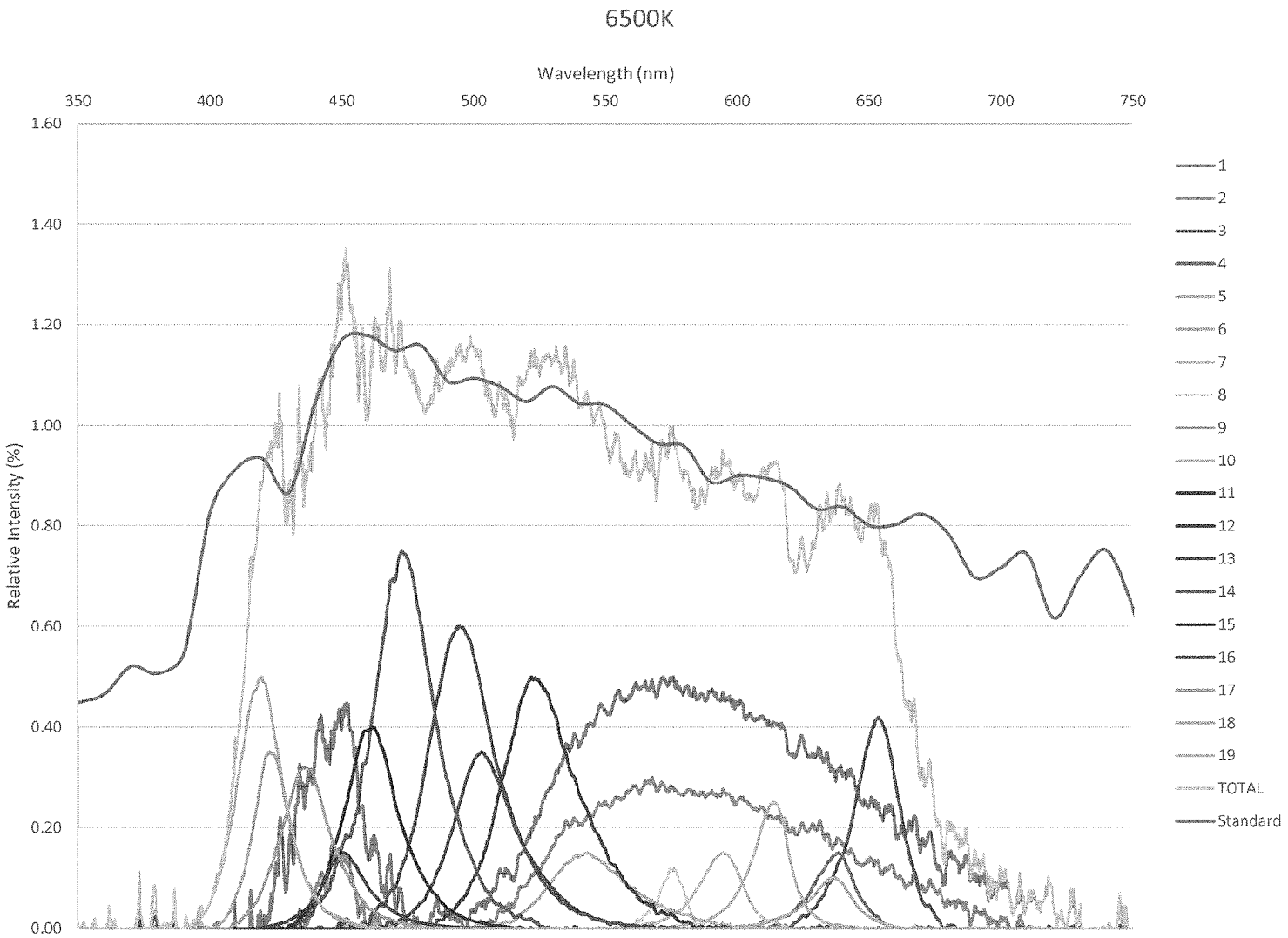
FIG. 9 is a graph showing the individual spectra of light sub-beams produced by a set of 18 colored light emitters and 1 white light emitter of a lighting system according to one embodiment, with relative intensities configured to provide natural light at a color temperature around 6500, as well as the combined spectral profile of the combination of the sub-beams compared with an acquired spectral of natural light at the same color temperature.

In some embodiments, the lighting system may be configured to reproduce target natural light representative of different times of the day. In some implementations, a progression of the natural light spectral profile over the course of a given operation period can be provided. In one example, the lighting system may be configured to substantially mimic the progression of natural light over the course of a day, in synchronization with actual outdoor light. As explained above, this may be achieved by changing the relative intensity of the different light sub-beams. FIGS. 7 to 9 illustrate this concept. These graphs show the relative intensities of a set of 19 light emitters at a color temperature of about 4000 K (representative of early morning light), 5700 K (midmorning) and 6500 K (around noon), as well as the resulting combined spectral profile of the output beam compared with the natural spectral profile of the target natural light.

Still referring to FIG. 1, the control module 25 may include a memory 30 in communication with the controller 24 and storing the driving parameters. The controller 24 which may be connected with one or more storage media, including the memory 30, which may include for example volatile and non-volatile computer memory such as RAM, PROM, EPROM, and EEPROM flash memory. Of note, while the memory 30 may be provided to store the various drive parameters and other controller 24 settings such as the built-in mathematical equations and solid-state light emitter parameter database (not shown) which allow for the lighting system 10 to be tunable, the controller 24 may alternatively be set to drive the solid-state light emitters 14 to generate only a single combined spectral profile 22, without requiring the memory 30. In an alternate embodiment, the drivers 26 are fixed to drive the solid-state light emitters 14 to generate a single combined spectral profile 22 and the controller 24 is not required. The memory 30 may illustratively be encoded with one or more software programs that, when executed on the controller 24, perform at least some of the functions discussed herein. The memory 30 may be permanently connected to the controller 24 or may be removable and transportable, so that more programs stored thereon can be executed by the controller 24 so as to control the various combined spectral profiles 22. Of note, the terms "program" or "computer program" is used in a generic sense to refer to any type of computer code (e.g. software or microcode) that can be employed to program one or more controllers 24.

Still referring to FIG. 1, the control module 25 may also include a communication interface 32 to allow that the memory 30 or controller 24 to be externally programmed via one or more communication protocols for example using a Universal Serial Bus (USB), Inter-Integrated Circuit (I2C), firewire, ethernet, Wi-Fi, ZigBee, or Bluetooth protocols. The programming of the memory 30 or controller 24 can be performed locally on the lighting system 10, for example via the communications interface 32, or remotely by providing a remote connection over wire or wirelessly.

Still referring to FIG. 1, the control module 25 may also include a power supply 34 which receives power from an AC or DC input 36 and supplies rated voltages to the associated components forming the control module 25. A user interface 38 which may send user control signals to the controller 24 may also be included in the control module 25. For example, the user interface 38 may include a dimmer switch which sends a dimming signal to the controller 24 which in turn calculates a lumen proportion needed for emissions from each solid-state light emitters 14 so that the combined spectral profile 22 stays representative of the target natural light. The controller 24 may also calculate the minimum number of solid-state light emitters 14 and electric current to be supplied by the drivers 26 needed to achieve the target CCTs and CRI while maximizing the lumen output in order to enhance the luminaire efficacy as specified by the ENERGY STAR® program.

Still referring to FIG. 1, the control module 25 and/or solid-state light emitters 14 may be disposed on a Printed Circuit Board ("PCB") and contained in a plastic or metal housing (both not shown). The drivers 26 may also be disposed on the same PCB as the solid-state light emitters 14 or otherwise be each integrated on a separate board or chip. The solid-state light emitters 14 may be separately grouped and arranged on the support structure 40 which may include a heat sink (not shown) for dissipating heat generated by the solid-state light emitters 14. For example the solid-state light emitters 14 may be grouped in a line or in a circular or rectangular pattern depending on the illumination design and surface area to be illuminated. As another example, the lighting system 10 may be embodied in light fixtures such as recessed can lighting with the solid-state light emitters 14 grouped on a mounting plate (not shown) in clusters and/or other arrangements such that the light fixture outputs a desired directed pattern of light on a surface or object.

According to another aspect of the present invention, there is provided a method for generating an output light beam representative of a target natural light having a natural light spectral profile. The method includes providing a plurality of solid-state light emitters each emitting a light sub-beam having an individual spectrum. The individual spectra of the solid-state light emitters collectively cover a visible portion of the natural light spectral profile and exclude infrared and ultraviolet components. The method further involves combining the light sub-beams from the solid-state light emitters into the output light beam, such that the output light beam has a combined spectral profile defined by a combination of the individual spectra of the plurality of solid-state emitters. Finally, the method includes controlling an intensity of the light sub-beam from each of the solid-state light emitters such that the combined spectral profile of the output light beam is representative of the natural light spectral profile over the visible portion.

Still referring to FIG. 1, in accordance with one embodiment the controller 24 may control the intensities of the solid-state light emitters 14 by varying their light output intensities over time to generate the output spectral profile 22 representative of the target natural light matching the seasonal natural light cycle. Of note, the term "seasonal natural light cycle" is used to refer to variations in light intensities and colours emitted by the Sun over the course of the seasons, which may also include variations in durations of sunlight during the course of a day, as a result of the yearly orbit of the Earth around the Sun and the tilt of the Earth's rotational axis relative to the plane of the orbit. For example, the intensities of the light sub-beams 16 emitted by the solid-state light emitters 14 may be varied to generate a combined spectral profile 22 representative of sunlight during summer, spring, fall, and winter over a given period, such as a year. Alternatively, the method could include varying the intensity of the light sub-beams 16 emitted by the solid-state light emitters 14 over time at a rate greater than the seasonal natural light cycle. For example, the intensity could be varied such that the combined spectral profile 22 is representative of sunlight during summer, spring, fall, and winter over a shorter period, for example four months, compared to the twelve month natural period. Alternatively, the method could include varying the intensity of the light sub-beams 16 emitted by the solid-state light emitters 14 over time to match a portion of the seasonal natural light cycle. For example, the intensity of the light sub-beams 16 emitted by the solid-state light emitters 14 could be varied such that the combined spectral profile 22 is representative of sunlight during only spring, summer, and fall, or another portion or combination of the above. For example, the intensity of the light sub-beams 16 emitted by the solid-state light emitters 14 could be varied such that the combined spectral profile 22 is representative of sunlight during only one month of spring, two months of summer, and then one month of spring, and another two months of summer on a repetitive basis. While the present description makes reference to varying the seasonal natural light cycle, other cycle or sub-cycle variations are possible, such as the variation of the daylight cycle, the variation of the daylight cycle over a shorter period of time, or the variation of certain portions of the daylight cycle.

The method for generating a target natural light may also include the step of supplying the solid-state light emitters 14 with PWM signals having adjustable duty cycles and frequencies to drive the solid-state light emitters 14 to emit light at an intensity proportional to the PWM signal.

While the present invention has been described in connection with preferred embodiments, however, it will be understood that there is no intent to limit the invention to the embodiments thus described. On the contrary, the intent is to cover all alternatives, modifications, and equivalents as may be included within the spirit and scope of the invention as defined by this specification, drawings, and the appended claims. The scope of the claims should thus not be limited by the preferred embodiments set forth in the examples, but should be given the broadest interpretation consistent with the description as a whole.

The invention claimed is:

1. A lighting system for generating an output light beam representative of a target natural light having a natural light spectral profile, the lighting system comprising:

a plurality of solid-state light emitters each emitting a light sub-beam having an individual spectrum, the individual spectra of the solid-state light emitters collectively covering a visible portion of the natural light spectral profile and excluding infrared and ultraviolet components;

a combining assembly combining the light sub-beams from said solid-state light emitters into the output light beam such that said output light beam has a combined spectral profile defined by a combination of the individual spectra of the plurality of solid-state emitters; and a control module configured for controlling an intensity of the light sub-beam from each of the solid-state light emitters such that the combined spectral profile of the output light beam is representative of the visible portion of the natural light spectral profile excluding said infrared and ultraviolet components.

2. The lighting system according to claim 1, wherein the solid-state emitters are Light Emitting Diodes.

3. The lighting system according to claim 1, wherein the control module comprises a controller configured to control driving parameters of the solid-state emitters.

4. The lighting system according to claim 3, wherein the control module further comprises a memory in communication with the controller and storing the driving parameters.

5. The lighting system according to claim 1, wherein the control module comprises a plurality of emitter drivers, each emitter driver being associated with a corresponding one of the solid-state light emitters.

6. The lighting system according to claim 1, wherein the control module controls the solid-state emitters according to a Pulse Width modulation scheme.

7. The lighting system according to claim 1, wherein the combining assembly comprises a support structure on which the solid-state light emitters are mounted.

8. The lighting system according to claim 7, wherein:

the light emitters are positioned on the support structure such that the light sub-beams project towards a diffusing plane; and the combining assembly further comprises a diffuser extending along the diffusing plane, the diffuser blending the light sub-beams into said output beam.

9. The lighting system according to claim 1, wherein the plurality of solid-state light emitters consists of between 12 and 20 of said light emitters.

10. The lighting system according to claim 1, wherein the plurality of solid-state light emitters consists of colored light emitters.

11. The lighting system according to claim 1, wherein the plurality of solid-state light emitters includes a plurality of colored light emitters and at least one white light emitter.

12. The lighting system according to claim 1, wherein the combined spectral profiles span a wavelength range extending between about 350 and 750 nm.

13. The lighting system according to claim 1, wherein the combined spectral profiles span a wavelength range extending between about 400 and 700 nm.

14. The lighting system according to claim 1, wherein the control module is configured to control the intensity of the light sub-beams according to a plurality of sets of relative intensity values each providing a combined spectral profile representative of a different natural light.

15. A method for generating an output light beam representative of a target natural light having a natural light spectral profile, the method comprising:

a) providing a plurality of solid-state light emitters each emitting a light sub-beam having an individual spectrum, the individual spectra of the solid-state light emitters collectively covering a visible portion of the natural light spectral profile and excluding infrared and ultraviolet components;

b) combining the light sub-beams from said solid-state light emitters into the output light beam such that said output light beam has a combined spectral profile defined by a combination of the individual spectra of the plurality of solid-state emitters; and c) controlling an intensity of the light sub-beam from each of the solid-state light emitters such that the combined spectral profile of the output light beam is representative of the visible portion of the natural light spectral profile excluding said infrared and ultraviolet components.

16. The method according to claim 15, wherein the controlling of the solid-state emitters is performed according to a Pulse Width modulation scheme.

17. The method according to claim 15, wherein the combining of the light sub-beams comprises:

projecting the light sub-beams towards a diffusing plane; and blending the sub-beams into said output beam using a diffuser extending along the diffusing plane.

18. The method according to claim 15, wherein the plurality of solid-state light emitters consists of between 10 and 20 of said light emitters.

19. The method according to claim 15, wherein the combined spectral profiles span a wavelength range extending between about 350 and 750 nm.

20. The method according to claim 15, wherein the combined spectral profile span a wavelength range extending between about 400 and 700 nm.

21. The method according to claim 15, wherein the intensity of the light sub-beams is controlled according to a plurality of sets of relative intensity values each providing a combined spectral profile representative of a different natural light.

22. The method according to claim 15, wherein the plurality of solid-state light emitters consists of colored light emitters.

23. The method according to claim 15, wherein the plurality of solid-state light emitters includes a plurality of colored light emitters and at least one white light emitter.

* * * * *